US008474394B2

(12) United States Patent
Fivgas

(10) Patent No.: US 8,474,394 B2
(45) Date of Patent: Jul. 2, 2013

(54) VERTICAL FLAG DISPLAY APPARATUS

(76) Inventor: Pamela Fivgas, Arvada, CO (US)

( * ) Notice: Subject to any disclaimer, the term of this patent is extended or adjusted under 35 U.S.C. 154(b) by 343 days.

(21) Appl. No.: 12/925,710

(22) Filed: Oct. 28, 2010

(65) Prior Publication Data

US 2011/0094436 A1 Apr. 28, 2011

Related U.S. Application Data

(60) Provisional application No. 61/279,943, filed on Oct. 28, 2009.

(51) Int. Cl.
*G09F 17/00* (2006.01)

(52) U.S. Cl.
USPC ..... 116/173; 248/538

(58) Field of Classification Search
USPC ..... 116/173, 174, 175; 40/617, 602, 40/603, 604; 248/538, 214, 219.2, 219.3; D11/165, 166, 181
See application file for complete search history.

(56) References Cited

U.S. PATENT DOCUMENTS

| | | | | | |
|---|---|---|---|---|---|
| 496,423 | A | * | 5/1893 | Locke | 116/173 |
| 1,295,274 | A | * | 2/1919 | Crichton | 116/174 |
| D76,456 | S | * | 10/1928 | Brenner et al. | D20/41 |
| 1,855,824 | A | * | 4/1932 | Crichton | 116/173 |
| 2,030,379 | A | * | 2/1936 | Lippold | 40/617 |
| 2,304,743 | A | * | 12/1942 | Schott | 40/617 |
| 3,310,899 | A | * | 3/1967 | Hart et al. | 40/604 |
| 3,564,743 | A | * | 2/1971 | Gilmoure et al. | 40/604 |
| 3,726,035 | A | * | 4/1973 | Bower et al. | 40/604 |
| 4,113,216 | A | * | 9/1978 | Fuse et al. | 248/573 |
| 5,016,372 | A | * | 5/1991 | Gold | 40/591 |
| 5,044,301 | A | * | 9/1991 | Peters et al. | 116/174 |
| 5,291,849 | A | * | 3/1994 | Zeitler | 116/174 |
| 5,428,913 | A | * | 7/1995 | Hillstrom | 40/604 |
| 6,192,611 | B1 | * | 2/2001 | Molla | 40/604 |
| 6,334,596 | B1 | * | 1/2002 | Temple | 248/156 |
| 6,402,116 | B1 | * | 6/2002 | Northup | 248/514 |
| 6,530,338 | B2 | * | 3/2003 | Okumura et al. | 116/173 |
| 6,726,170 | B2 | * | 4/2004 | Luo | 248/538 |
| D576,915 | S | * | 9/2008 | Reden | D11/165 |
| 2004/0250458 | A1 | * | 12/2004 | Kim | 40/617 |
| 2011/0180683 | A1 | * | 7/2011 | Lach et al. | 248/538 |

FOREIGN PATENT DOCUMENTS

| | | | | |
|---|---|---|---|---|
| EP | 1662462 | A1 | * | 5/2006 |
| JP | 2004037788 | A | * | 2/2004 |
| JP | 2004191470 | A | * | 7/2004 |
| JP | 2008191589 | A | * | 8/2008 |
| JP | 2009048001 | A | * | 3/2009 |

* cited by examiner

*Primary Examiner* — R. A. Smith

(57) ABSTRACT

A vertical flag display apparatus comprises a support bar, a flag spar, a flag pole, and locking end caps. The flag spar can be a rod, bar, or other tubular pole. The flag spar threads through a flag sleeve so that the flag hangs down from the spar when the spar is held parallel to the ground. The locking end caps attach to an end of the spar and ensure that the flag can not slide off of the spar. The end caps attach to each end of the support bar securing the spar to the support bar. The flag pole attaches to the support bar and extends downwards and perpendicular to the support bar. The flag pole is attached to the side of a building, etc. so as to hold the flag pole generally 45 degrees out from the side of the building and in an upwards orientation.

20 Claims, 6 Drawing Sheets

VERTICAL FLAG DISPLAY APPARATUS

CROSS-REFERENCE TO RELATED APPLICATIONS

This application claims the benefit of U.S. Provisional Application No. 61/279,943 entitled "Improved Apparatus for Displaying a Flag Vertically" and filed on Oct. 28, 2009.

TECHNICAL FIELD

The invention relates generally to flags and flag display devices and more particularly to a vertical flag display apparatus for displaying a flag in a vertical orientation generally parallel to a wall or other location.

BACKGROUND

There are many methods for hanging and/or displaying a flag currently known. The classic flag pole relies on a generally vertical pole fixed to the ground or other location with a flag attached to a rope apparatus that can be used to raise the flag from the ground to the top of the pole. Generally speaking, flags are rectangular in shape, having two short sides and two long sides defining the perimeter of the flag. Usually, one of the short sides is attached to the rope apparatus. Thus, when the wind blows, it causes the flag to extend outwards, such that the long sides of the flag extend parallel to the ground. The flag is then displayed for all to see. However, when the wind is not blowing, a standard flag display apparatus allows the flag to hang limply from the rope apparatus. Most of the flag is then folded over itself, causing the entire field of the flag not to be viewable.

Flags are basically two dimensional in appearance, comprising a sheet of fabric or other material(s) having a front face and a rear face, both faces surrounded by a rectangular perimeter having two opposite and parallel short sides and two opposite and parallel long sides. The faces display the field of the flag; usually the same field is displayed on both faces of the flag. The field can depict a design, a motto, an emblem, a picture, a phrase, one or more colors, combinations of the aforementioned items, etc. For example, the United States flag has a blue rectangle covered in 50 white stars in the upper left of the field and the remainder of the field has alternating red and white stripes. When a US flag is displayed from a standard flag pole and the wind is not blowing, the configuration of the items displayed in the field can be difficult to discern.

In order to overcome this deficiency in standard flag display devices, other types of devices have begun to grow in popularity. One class of devices holds rectangular flags in a rigid manner so that they extend out from a flagpole or other structure regardless of whether a wind is blowing or not. However, such devices give the flag a stiff, unappealing appearance and are not favored. Instead, many persons display flags in a vertical orientation where the long sides of the flag hang downwards and are perpendicular to the ground. Vertical flag display devices that can display a flag in this manner are varied; but generally, they have a spar or horizontal member which holds one of the short ends of the flag and allows the flag to hang vertically. A problem inherent in most such vertical display devices lies in the attachment of the flag to the spar. Nails, tacks, etc. are often employed which can damage the flag, especially with repeated use.

U.S. Pat. No. 6,402,116 to Northup attempts to overcome the above mentioned deficiency by employing a flag having a channel through which the spar (or dowel) is slid. The flag and spar are then inserted into a sleeve having a slit through which the flag can extend downwards. The sleeve has a threaded opening in its sidewall that accepts a threaded support pole. When the pole is screwed into the opening it places pressure on the flag and dowel, securing the flag to the dowel without puncturing the flag. However, this arrangement has a number of deficiencies itself. First, the end of the support pole that is pushing against the flag wears on the flag each time it is affixed to the sleeve, causing a wear spot to develop on the flag. Such a spot can eventually become a hole in the flag—exactly the problem that the Northup device was designed to avoid. Furthermore, in heavy winds, the dowel, flag and sleeve can be rotated by the wind relative to the support pole, causing the device to separate and the flag to be lost as the support pole no longer puts pressure on the flag. Finally, the Northup device also has no provision for securing the corners of the flag on the ends of the dowel such that a high wind can cause the loose corners to be pushed towards the support pole and the flag then 'bunches-up' making it difficult for an observer to see the entire field.

What is needed is a flag display apparatus that can hold a flag in a vertical orientation without damaging the flag and without the possibility of losing the flag in high winds.

SUMMARY

One embodiment of the present invention is a device comprising a support bar, a flag spar, a flag pole, locking end caps, securing clips, and an attachment bracket. A vertical flag display apparatus can display various types of flags without damaging them. If the flag to be displayed has a sleeve on one of its edges, the apparatus can use a standard flag spar. The flag spar can be a rod, bar, or other tubular pole that is approximately as long as the sleeve of the flag. In other embodiments, the flag spar is longer or shorter than the length of the sleeve. The flag spar can be threaded through the sleeve so that the flag hangs down from the spar when the spar is held parallel to the ground. Each of the locking end caps then attach to an end of the spar in order to ensure that the flag can not slide off the spar. Securing clips can be placed on each end of the spar and function to hold the flag corners in place under high-wind conditions. The end caps then attach to each end of the support bar securing the spar to the support bar. The support bar extends generally parallel to and above the spar in one embodiment. The flag pole attaches to approximately the center of the support bar and extends generally 45 degrees downwards and perpendicular to the support bar. The flag pole is then placed in the attachment bracket and the bracket is attached to the side of a building or other location so as to hold the flag pole generally 45 degrees out from the side of the building and in an upwards orientation. Other angles besides 45 degrees are contemplated. The described device holds the flag in a vertical orientation so that it is parallel with the side of the building. However, as the flag is only in contact with the device along the length of the flag spar, the remainder of the flag is free to flutter and move with the wind.

If the flag to be displayed does not have a sleeve, the flag spar can be configured to securely hold an edge of a standard flag. Various mechanisms are contemplated including a clamp bar that holds the entire length of the flag to the spar. In another embodiment, the spar contains a channel in which the edge of a flag can be inserted and then the spar closes tightly on the flag ensuring that it is secured therein.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein.

DETAILED DESCRIPTION

In the following discussion, numerous specific details are set forth to provide a thorough understanding of the present invention. However, those skilled in the art will appreciate that the present invention may be practiced without such specific details.

Figure 1:
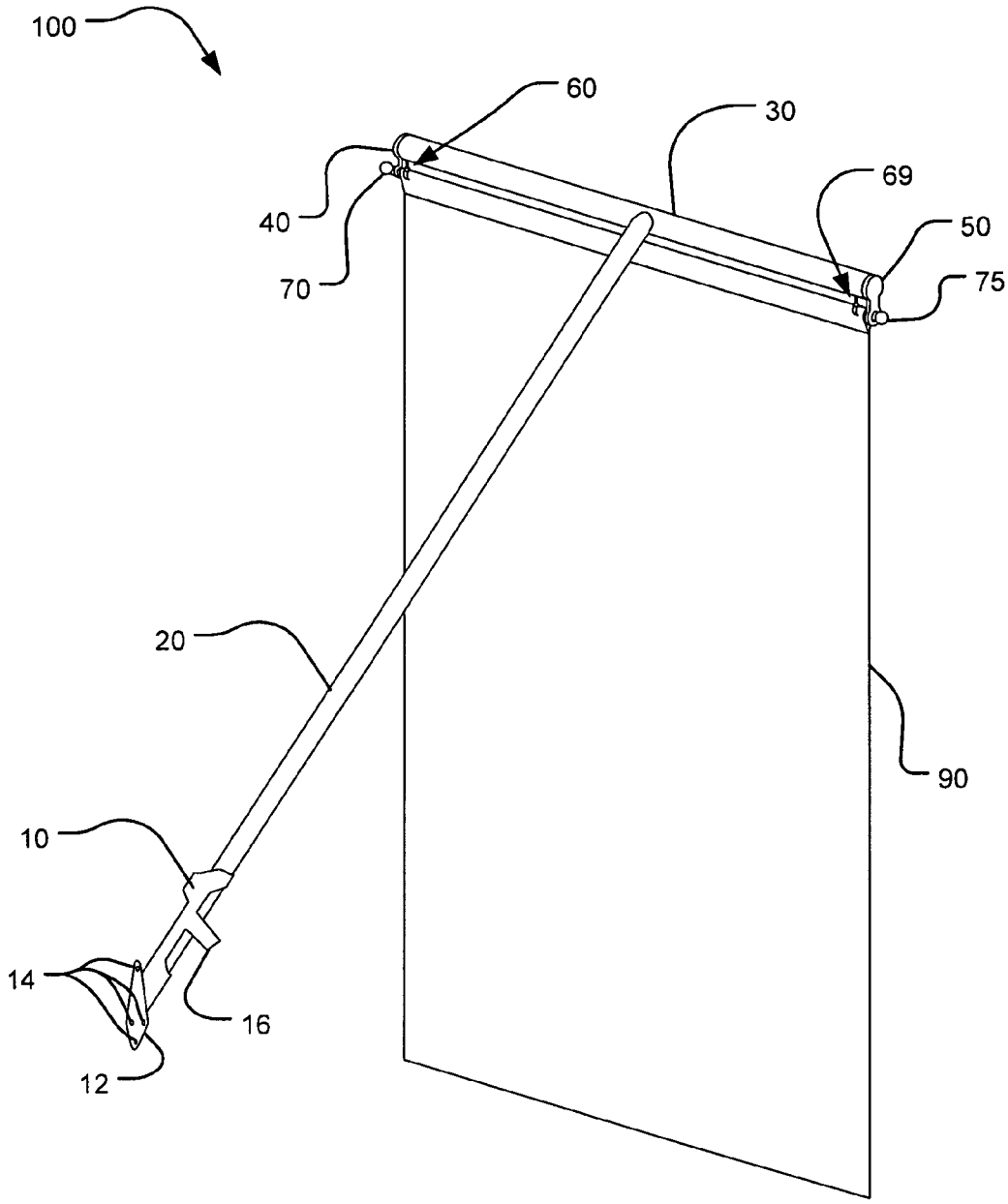
FIG. 1 illustrates a perspective view of a vertical flag display apparatus in accordance with an aspect of the present invention.

Referring now to the drawings, FIG. 1 illustrates a perspective view of a vertical flag display apparatus 100 in accordance with an aspect of the present invention. The embodiment shown in FIG. 1 has the following displayed components: an attachment bracket 10, a pole 20, a support bar 30, a first locking end cap 40, a second locking end cap 50, a first locking clip 60, a second locking clip 69, a first accent cap 70, and a second accent cap 75. Also shown is an exemplary flag 90. A flag spar is used to support the flag 90, but the spar is not visible in FIG. 1, see FIG. 2, item 80.

The attachment bracket 10 illustrated in FIG. 1 is shaped with a generally flat attachment plate 12 having mounting holes 14 that accept fasteners to attach the bracket 10 to a wall or other attachment point. In other embodiments, other means of attaching the attachment bracket 10 to an attachment point are contemplated. Furthermore, the attachment bracket 10 does not have to have a generally flat attachment plate 12, instead, it can be shaped to generally match the surface of the attachment point. The attachment bracket 10 is illustrated in FIG. 1 as having a second angled receptacle 16 for receiving the pole 20 at a second angle. Other embodiments can have only one receptacle or a plurality thereof.

The pole 20 has a proximal end that rests in the receptacle of the bracket 10. The distal end of the pole 20 attaches to the support bar 30. As illustrated in FIG. 1, the pole can be generally straight in shape; other shapes of poles 20 are known in the art and can be utilized herewith. The function of the pole 20 is to extend the position of the flag 90 out away from the attachment point. The pole 20 shown in FIG. 1 has a cross-section that is generally shaped as a circle, other shapes are contemplated.

Figure 2:
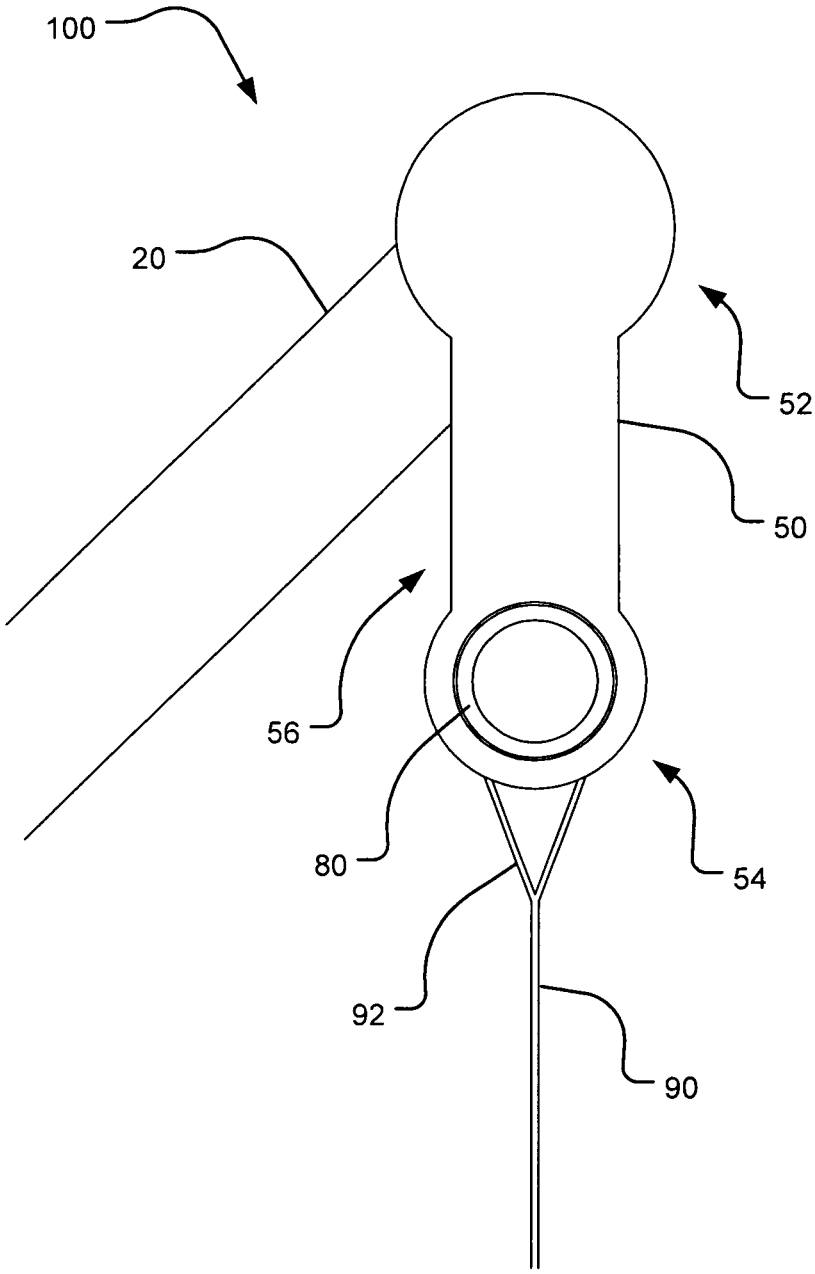
FIG. 2 illustrates a close-up side view of a vertical flag display apparatus.

The pole 20 is connected to the support bar 30. As shown in FIG. 2, the distal end of the pole 20 contacts the support bar 30. The attachment can be permanent or it can be removably affixed. As shown in FIG. 2, the distal end of the pole can be shaped so as to closely match the curved surface of the support bar 30. A simple removable connection means such as a screw can be used to affix the support bar 30 to the pole 20. Other attachment means are contemplated.

The support bar 30 is shown in FIG. 1 as being generally cylindrical in shape. However, in other embodiments, the support bar 30 can be other shapes. The support bar 30 functions as an intermediary support structure between the flag spar (see item 80 in FIG. 2) and the pole 20.

At each end of the support bar 30 is a locking end cap 40 and 50. The end caps are designed to lock securely to the support bar 30 and receive and hold the flag spar. See the descriptions of FIGS. 2-5 for further explanations of the locking end caps 40 and 50.

In order to mount a flag on the vertical flag display apparatus 100, the flag spar is removed from at least one of the locking end caps 40 and 50 and the flag 90 is attached thereto. In the embodiment shown in FIG. 1, the flag 90 has a sleeve which slides over the flag spar. In other embodiments, the flag spar can have a channel for receiving an end of the flag 90 and then can be tightened so as to secure the flag 90 to the flag spar—such embodiments allow flags that do not have a sleeve to be flown by the apparatus 100.

Once the flag 90 is affixed to the flag spar, the spar is reattached to the locking end caps 40 and 50. In one embodiment, first and second locking clips 60 and 69 can then be secured over the flag 90 to ensure that the flag 90 stays in place on the flag spar even in high-wind conditions. In other embodiments, other means of securing the flag 90 to the spar can be used. In yet another embodiment, no means of securing the flag 90 are used.

The first and second accent caps 70 and 75 attach at either end of the flag spar outside of the first and second locking end caps 40 and 50 in order to secure the Flagstar to the end caps 40 and 50. For additional descriptions of the accent caps 70 and 75, see FIG. 5 and descriptions thereof below.

Once the flag 90 is properly secured to the vertical flag display apparatus 100, the pole 20 can be placed in the attachment bracket 10 and the flag 90 is then on display. As can be seen in FIG. 1, a flag 90 displayed using the apparatus 100 hangs vertically with both fields in full view, even if no wind is present to move the flag 90.

FIG. 2 illustrates a close-up side view of a vertical flag display apparatus 100. The distal end of a flag pole 20 can be seen as can the conforming shape of the attachment point thereof as it meets the support bar 30 (not shown in FIG. 2, see FIG. 1). Other shapes are contemplated as are other means of attaching the pole 20 to the support bar 30 (for a description of one possible means, see FIG. 1 description above).

Figure 3:
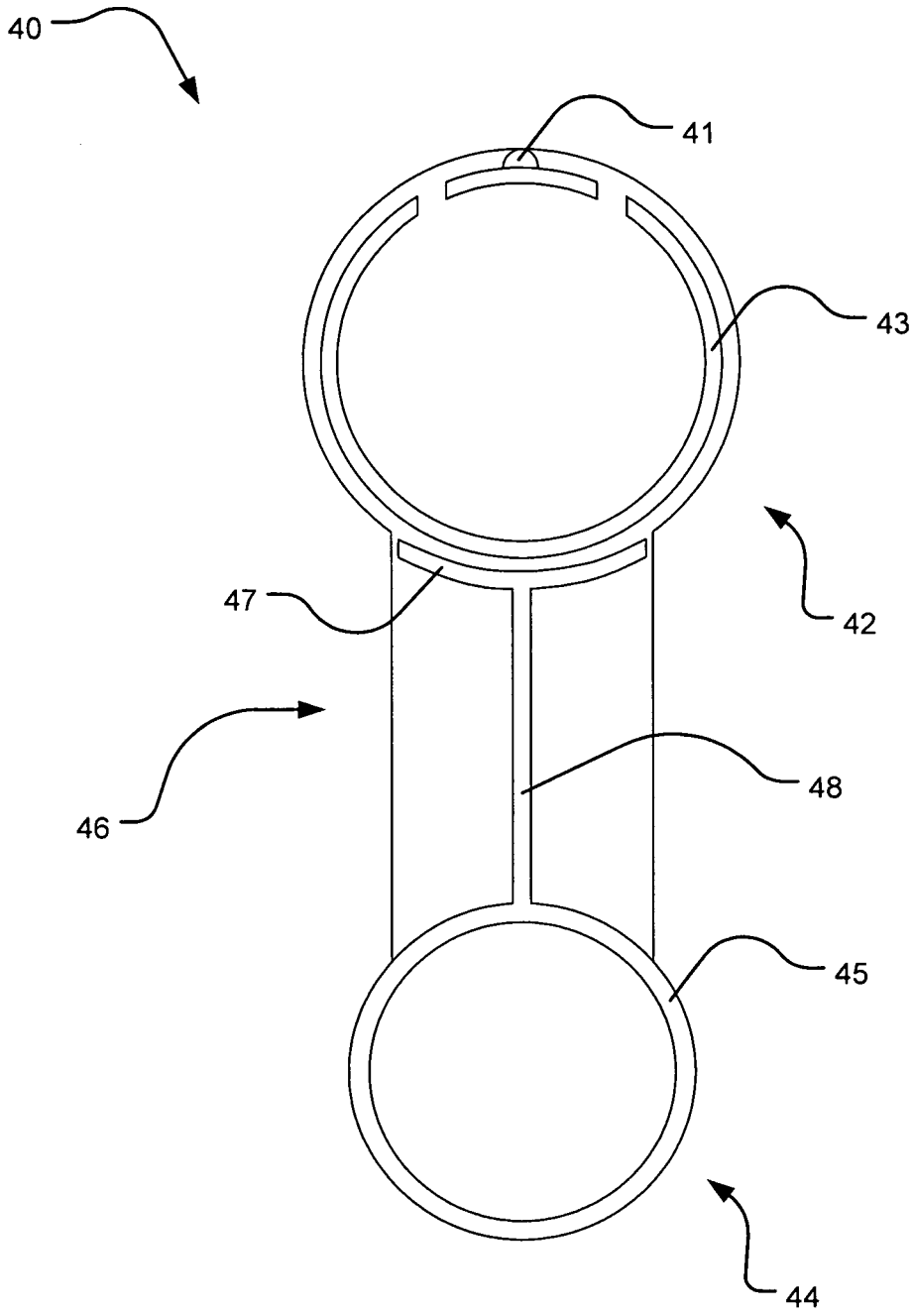
FIG. 3 illustrates a close-up front elevation view of a locking end cap component of a vertical flag display apparatus.

A second locking end cap 50 is illustrated in FIG. 2 it is a mirror of the first locking end cap 40 (see FIGS. 1 and 3 for more details about the first locking end cap 40). The second locking end cap 50 has a second support bar cap component 52, a flag second spar cap component 54, and a second extension component 56 connecting the first two components 52 and 54. The support second bar cap component 52 connects the second locking end cap 50 to one end of the support bar 30. For a detailed description of how one embodiment accomplishes this connection, see the description for FIG. 3 below. The second flag spar cap component 54 connects the second locking end cap 50 to one end of the flag spar 80.

As illustrated in FIG. 2, the flag spar 80 is cylindrically shaped and passes completely through the second flag spar cap component 54 of the second locking end cap 50. In order for the flag spar 80 to be visible, the accent cap 75 (see FIG. 1) is not attached to the end of the flag spar 80 in FIG. 2. For descriptions thereof, see FIG. 5, item 70 (which is a mirror of item 75).

The second extension component 56 functions to adequately space the support bar 30 from the flag spar 80. This is done for appearances and to allow the flag 90 to be supported by the spar 80 without contacting and rubbing on the support bar 30. Furthermore, the spacing allows room for the locking clips 60 and 69 to secure the flag 90 to the spar 80.

The flag 90 illustrated in FIG. 2 has a sleeve 92 that allows the flag spar 80 to be inserted therein. As noted above, the apparatus 100 can be used with a standard flag that does not have a sleeve.

FIG. 3 illustrates a close-up front elevation view of a first locking end cap 40 of a vertical flag display apparatus. The first locking end cap 40 is illustrated in FIG. 3. The second locking end cap 50 is not shown in FIG. 3, see FIGS. 1 and 2. The second locking end cap 50 can have subcomponents (see those listed in the FIG. 2 description above) that are a mirror of those shown in FIG. 3 for the first locking end cap 40. The first locking end cap 40 has a first support bar cap component 42, a first flag spar cap component 44, and a first extension component 46 connecting the first two components 42 and 44.

The first support bar cap component 42 connects the first locking end cap 40 to one end of the support bar 30. In one embodiment, this is accomplished by sliding the first support bar flange 43 in one end of the support bar 30. The fit between these two components is such that the first locking end cap 40 is tightly held within the support bar 30. Additionally a first locking spring button flange 41 also can be utilized; it slides into the support bar 30 as well. The sliding action forces the first locking spring button flange 41 downwards and causes tension~ as the first locking spring button flange 41 can be made of a springy, resilient material. When the first locking spring button flange 41 is fully seated within the support bar 30, a spring button pops up into a hole in the support bar 30 releasing at least some of the tension on the first locking spring button flange 41 and thereby securing the first locking end cap 40 to the support bar 30.

The first flag spar cap component 44 connects the first locking end cap 40 to one end of the flag spar 80. This is accomplished by inserting one end of the flag spar 80 through the first flag spar flange 45. The fit between these components can be made tight enough so that no further securing means is necessary. However, in one embodiment, a first accent cap 70 (see FIG. 1) having an outside diameter greater than the inside diameter of the first flag spar flange 45 can be attached to the end of the flag spar 80 effectively stopping the flag spar 80 from sliding back through the first flag spar flange 45. For a more detailed description of the accent cap 70 see FIG. 5 and its descriptions below.

The first extension component 46 has two additional flanges as well. The first is a first secondary support bar flange 47 that serves to further engage the support bar 30 and ensure that the first locking end cap 40 is secured to the support bar 30. The second flange is the first rigidity flange 48 which serves to provide strength and rigidity to the first extension component 46. Other means of accomplishing these goals are contemplated. Note that because the first and second locking end caps 40 and 50 can be mirrors of each other, the descriptions above can be applied to the second locking end cap 50 (see FIGS. 1 and 2) and its constituent parts as well.

Figure 4:
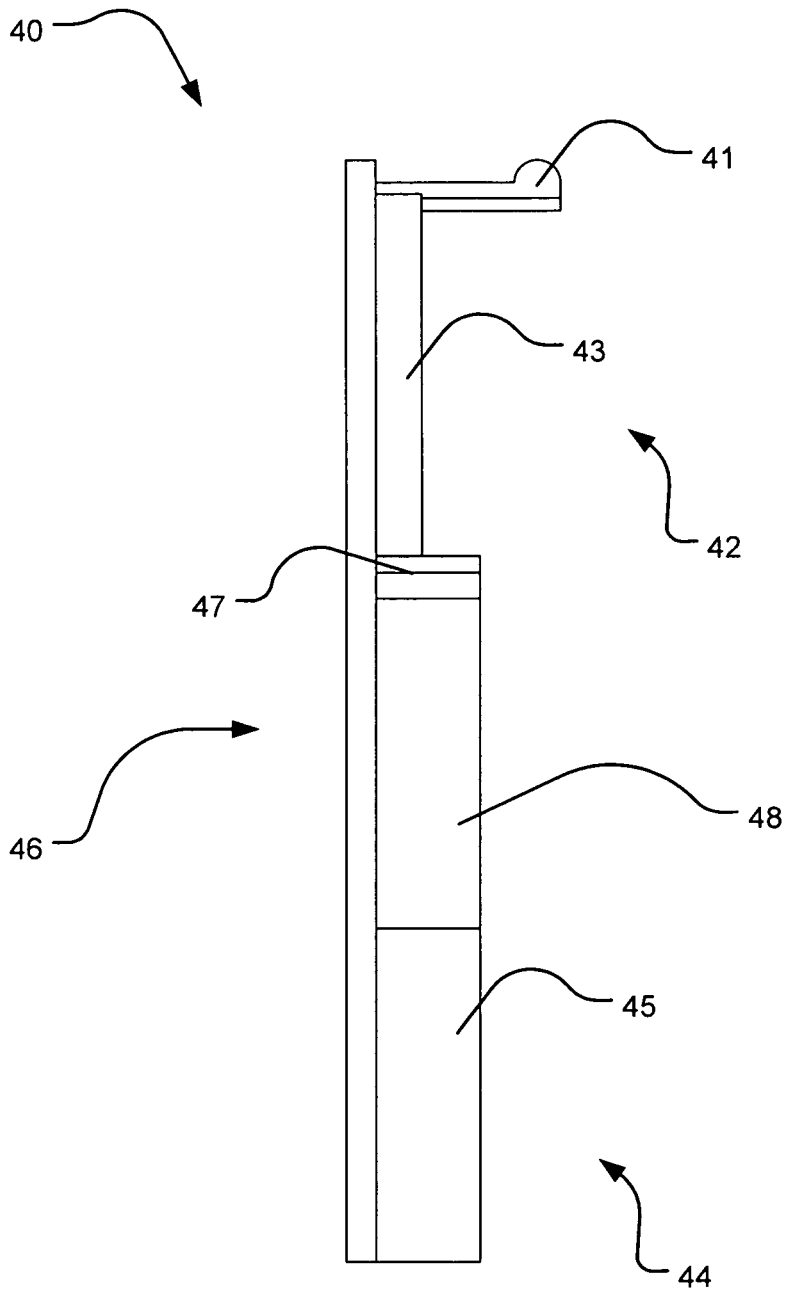
FIG. 4 illustrates a close-up side elevation view of a locking end cap component.

FIG. 4 illustrates a close-up side elevation view of a first locking end cap 40. The first support bar cap component 42, first flag spar cap component 44, first extension component 46, first support bar flange 43, first locking spring button flange 41, first flag spar flange 45, first secondary support bar flange 47, and first rigidity flange 48 are shown from the side view (see FIG. 3 for an additional view of these components). Note that because the first and second locking end caps 40 and 50 can be mirrors of each other, the descriptions above can be applied to the second locking end cap 50 (see FIGS. 1 and 2) and its constituent parts as well.

Figure 5:
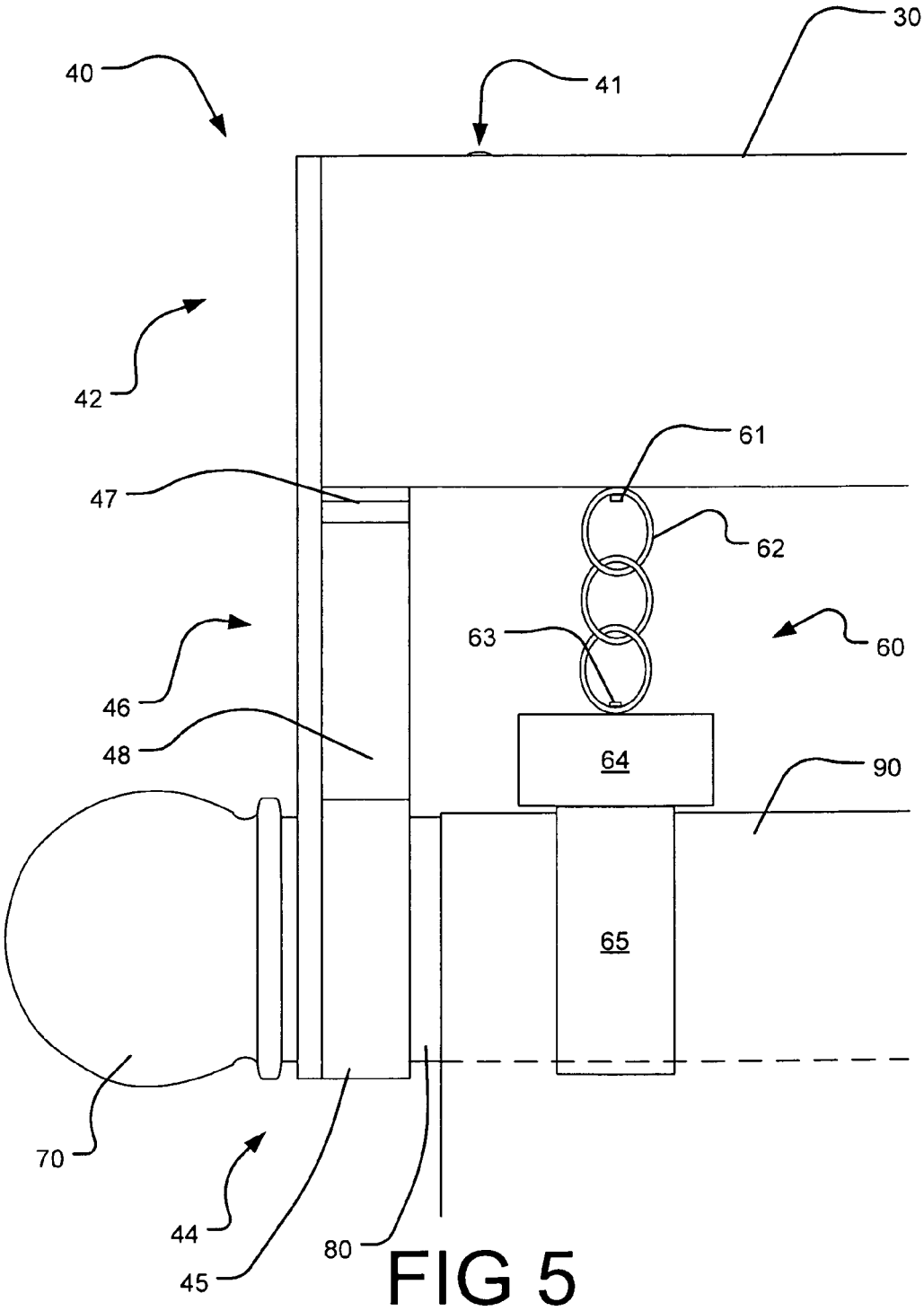
FIG. 5 illustrates a close-up side elevation view of a locking end cap and a locking clip.

FIG. 5 illustrates a close-up side elevation view of a first locking end cap 40 and a first locking clip 60. The first support bar cap first flag spar flange 45. For a more detailed description of the accent cap 70 see FIG. 5 and its descriptions below.

The first extension component 46 has two additional flanges as well. The first is a first secondary support bar flange 47 that serves to further engage the support bar 30 and ensure that the first locking end cap 40 is secured to the support bar 30. The second flange is the first rigidity flange 48 which serves to provide strength and rigidity to the first extension component 46. Other means of accomplishing these goals are contemplated. Note that because the first and second locking end caps 40 and 50 can be mirrors of each other, the descriptions above can be applied to the second locking end cap 50 (see FIGS. 1 and 2) and its constituent parts as well.

FIG. 4 illustrates a close-up side elevation view of a first locking end cap 40. The first support bar cap component 42, first flag spar cap component 44, first extension component 46, first support bar flange 43, first locking spring button flange 41, first flag spar flange 45, first secondary support bar flange 47, and first rigidity flange 48 are shown from the side view (see FIG. 3 for an additional view of these components). Note that because the first and second locking end caps 40 and 50 can be mirrors of each other, the descriptions above can be applied to the second locking end cap 50 (see FIGS. 1 and 2) and its constituent parts as well.

FIG. 5 illustrates a close-up side elevation view of a first locking end cap 40 and a first locking clip 60. The first support bar cap component 42, first flag spar cap component 44, first extension component 46, first locking spring button flange 41, first flag spar flange 45, first secondary support bar flange 47, and first rigidity flange 48 are shown from the side view (see FIGS. 3 and 4 for additional views of these components).

Additionally, FIG. 5 illustrates the first accent cap 70. The first cap 70 removably attaches to the flag spar 80 and locks the spar 80 to the first locking end cap 40. The support bar 30 is locked to the first support bar cap component 42 as well.

A first locking clip 60 is illustrated in FIG. 5. The first clip 60 has a first support bar attachment component 61 that can be any means of attaching the first clip 60 to the support bar 30. In the embodiment shown here, it is a small bolt. A first chain 62 attaches the first support bar attachment component 61 to the first clip attachment component 63 (here, another small bolt). In other embodiments, other means of attaching the clip components to the support bar 30 are contemplated. The first clip handles 64 and the first clip body 65 are shown in FIG. 5, for a description of their functionality, see FIG. 6 below. Note that because the first clip 60 and the second clip 69 can be mirrors of each other, the descriptions above can be applied to the second clip 69 (see FIG. 1) and its constituent parts as well.

Figure 6:
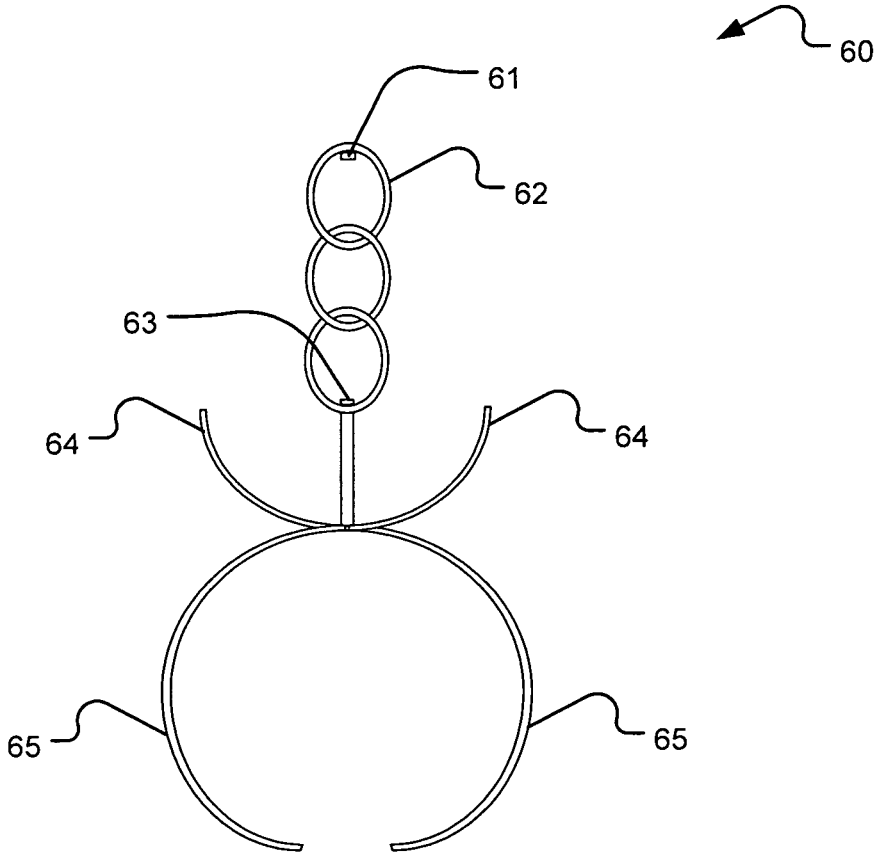
FIG. 6 illustrates a close-up front elevation view of a locking clip.

FIG. 6 illustrates a close-up front elevation view of a first locking clip having a first support bar attachment component 61, a first chain 62, a first clip attachment component 63, first clip handles 64 and a first clip body 65 are shown in FIG. 6. In the embodiment shown in FIG. 6, the first clip body 65 grasps the flag spar 80 and squeezes the flag sleeve 92 tightly against the flag spar 80. Spring tension in the first clip 60 secures the hold and ensures that the flag 90 can not slide up and down the flag spar 80 when under heavy wind conditions. A user can squeeze the first clip handles 64 together and release the first clip body 65 from the flag 90 and flag spar 80 in order to move, remove, or replace the flag 90.

When fully assembled, the flag pole 20 is attached to the support bar 30. The attachment point is approximately the center of the support bar 30. In other embodiments, other attachment points can be utilized. In yet other embodiments, more than one flag pole 20 can be used to securely hold the support bar 30 in a given position.

In one embodiment, the flag pole 20 comprises two or more sections that can be detached or separated from one another for ease of storage. Such sections can attach to one another via screw-type threads, shock-cords and male/female ends, telescoping and locking components, etc.

Likewise, the flag spar 80 is depicted as being a cylindrical dowel, but can be shaped differently in other embodiments.

In one embodiment, the flag spar 80 comprises two or more sections that can be detached or separated from one another for ease of storage. Such sections can attach to one another via screw-type threads, shock-cords and male/female ends, telescoping and locking components, etc.

Not shown in the FIGS. is an optional flag storage compartment that can be added to the apparatus to store and protect a flag 90 when it is not actively being displayed. In another embodiment, the flag spar 80 can be configured to rotate so that the flag 90 can be wound around the flag spar 80 and the storage compartment can be extended down from the support bar 30 to enclose the stored flag 90 and the flag spar 80. As an example, the rotating flag spar 80 can act in a manner similar to a window shade where the exposed end of a flag 90 is pulled to rotate the spar 80 and extend the flag 90 into displayed position. When the flag 90 is to be stored, a sharp downwards tug releases the roll-up mechanism allowing the spar 80 to rotate and roll-up the flag 90 into a stored position.

Also not shown in FIG. 1 is an optional flag retention piece. In one embodiment, the flag retention piece could be a high-friction material such as rubber or other non-slip material that is attached to the flag spar 80 in order to reduce the possibility of the flag sleeve 92 slipping on the flag spar 80.

It is contemplated that in some embodiments, the support bar 30 could be in close proximity to the spar 80 in order to securely hold the flag 90 between them.

The above specification, examples and data provide a description of the structure and use of exemplary embodiments of the described articles of manufacture and methods. It will further be understood from the foregoing description that various modifications and changes may be made in the embodiments of the present invention without departing from its true spirit. This description is intended for purposes of illustration only and should not be construed in a limiting sense. The scope of this invention should be limited only by the language of the following claims.

What is claimed is:

1. A vertical flag display apparatus, comprising:

a support bar having a first support end and a second support end;

a flag spar having a first spar end and a second spar end;

a flag pole having a distal end and a proximal end;

a first locking end cap and a second locking end cap; and wherein the flag pole is attached near the center of the support bar, the first locking end cap is attached to the first support end and the second locking end cap is attached to the second support end, and the first locking end cap is attached to the first spar end and the second locking end cap is attached to the second spar end such that a flag can be hung from the flag spar between the first and second locking end caps.

2. The apparatus of claim 1 wherein the flag spar is configured to slide through a sleeve on a flag.

3. The apparatus of claim 2 wherein the first and second locking end caps are configured to removably attach to either the first flag spar end or the second spar end such that when attached, the first and second locking end caps secure the flag onto the flag spar and hold the flag spar in a fixed orientation relative to the support bar.

4. The apparatus of claim 3 further comprising an attachment bracket configured to accept the proximal end of the flag pole and to hold the flag pole securely relative to an attachment point.

5. The apparatus of claim 2 further comprising an attachment bracket configured to accept the proximal end of the flag pole and to hold the flag pole securely relative to an attachment point.

6. The apparatus of claim 5 further comprising a first accent cap and a second accent cap wherein the first accent cap secures the first spar end to the first locking end cap and the second accent cap secures the second spar end to the second locking end cap.

7. The apparatus of claim 2 further comprising a first accent cap and a second accent cap wherein the first accent cap secures the first spar end to the first locking end cap and the second accent cap secures the second spar end to the second locking end cap.

8. The apparatus of claim 2 further comprising a first locking clip and a second locking clip wherein the first locking clip is configured to secure a first flag end to the first spar end and the second locking clip is configured to secure a second flag end to the second spar end.

9. The apparatus of claim 1 wherein the flag spar is configured to securely receive and hold an edge of a flag.

10. The apparatus of claim 9 wherein the first and second locking end caps are configured to removably attach to either the first flag spar end or the second spar end such that when attached, the first and second locking end caps secure the flag onto the flag spar and hold the flag spar in a fixed orientation relative to the support bar.

11. The apparatus of claim 10 further comprising an attachment bracket configured to accept the proximal end of the flag pole and to hold the flag pole securely relative to an attachment point.

12. The apparatus of claim 10 further comprising a first accent cap and a second accent cap wherein the first accent cap secures the first spar end to the first locking end cap and the second accent cap secures the second spar end to the second locking end cap.

13. The apparatus of claim 12 further comprising a first locking clip and a second locking clip wherein the first locking clip is configured to secure a first flag end to the first spar end and the second locking clip is configured to secure a second flag end to the second spar end.

14. The apparatus of claim 9 further comprising an attachment bracket configured to accept the proximal end of the flag pole and to hold the flag pole securely relative to an attachment point.

15. The apparatus of claim 1 further comprising an attachment bracket configured to accept the proximal end of the flag pole and to hold the flag pole securely relative to an attachment point.

16. The apparatus of claim 15 further comprising a first accent cap and a second accent cap wherein the first accent cap secures the first spar end to the first locking end cap and the second accent cap secures the second spar end to the second locking end cap.

17. The apparatus of claim 15 further comprising a first locking clip and a second locking clip wherein the first locking clip is configured to secure a first flag end to the first spar end and the second locking clip is configured to secure a second flag end to the second spar end.

18. The apparatus of claim 1 further comprising a first accent cap and a second accent cap wherein the first accent cap secures the first spar end to the first locking end cap and the second accent cap secures the second spar end to the second locking end cap.

19. The apparatus of claim 18 further comprising a first locking clip and a second locking clip wherein the first locking clip is configured to secure a first flag end to the first spar end and the second locking clip is configured to secure a second flag end to the second spar end.

20. The apparatus of claim 1 further comprising a first locking clip and a second locking clip wherein the first locking clip is configured to secure a first flag end to the first spar end and the second locking clip is configured to secure a second flag end to the second spar end.

* * * * *